US009765794B2

(12) United States Patent
Findeisen

(10) Patent No.: US 9,765,794 B2
(45) Date of Patent: Sep. 19, 2017

(54) MOTOR-VEHICLE FAN WHEEL WITH REINFORCED SHROUD

(71) Applicant: BROSE FAHRZEUGTEILE GMBH & CO. KG, WUERZBURG, Wuerzburg (DE)

(72) Inventor: Antje Findeisen, Oldenburg (DE)

(73) Assignee: Brose Fahrzeugteile GmbH & Co. KG, Wuerzburg, Wuerzburg (DE)

( * ) Notice: Subject to any disclaimer, the term of this patent is extended or adjusted under 35 U.S.C. 154(b) by 749 days.

(21) Appl. No.: 14/138,336

(22) Filed: Dec. 23, 2013

(65) Prior Publication Data

US 2014/0105746 A1 Apr. 17, 2014

Related U.S. Application Data

(63) Continuation of application No. PCT/EP2012/002519, filed on Jun. 15, 2012.

(30) Foreign Application Priority Data

Jun. 22, 2011 (DE) ..... 10 2011 105 451

(51) Int. Cl.
*F04D 29/32* (2006.01)
*F04D 29/02* (2006.01)

(52) U.S. Cl.
CPC ..... *F04D 29/325* (2013.01); *F04D 29/023* (2013.01); *F04D 29/326* (2013.01)

(58) Field of Classification Search
CPC ..... F04D 29/40; F04D 29/403; F04D 29/522; F04D 29/526; F04D 29/326; F04D 29/325; F04D 29/329; F04D 29/023
See application file for complete search history.

(56) References Cited

U.S. PATENT DOCUMENTS

| | | | | |
|---|---|---|---|---|
| 4,358,245 | A | 11/1982 | Gray | |
| 5,249,927 | A | 10/1993 | Vera | |
| 5,297,931 | A | 3/1994 | Yapp et al. | |
| 6,027,307 | A | 2/2000 | Cho et al. | |
| 6,508,624 | B2 * | 1/2003 | Nadeau | F01D 5/225 415/173.3 |
| 6,755,157 | B1 | 6/2004 | Stevens et al. | |
| 7,025,570 | B2 | 4/2006 | Jung et al. | |

(Continued)

FOREIGN PATENT DOCUMENTS

| | | | |
|---|---|---|---|
| CN | 1236866 | A | 12/1999 |
| CN | 1534199 | A | 10/2004 |
| CN | 101101006 | A | 1/2008 |

(Continued)

OTHER PUBLICATIONS

International Search Report of PCT/EP2012/002519, Dated Aug. 3, 2012.

*Primary Examiner* — Gregory Anderson
*Assistant Examiner* — Julian Getachew
(74) *Attorney, Agent, or Firm* — Laurence A. Greenberg; Werner H. Stemer; Ralph E. Locher

(57) ABSTRACT

A fan of a motor vehicle is particularly suited as a main fan of an internal combustion engine. The fan has a fan wheel with an outer ring which has a substantially L-shaped ring cross section. The L-shape is defined with a radial limb and an axial limb. The radial limb has a cross-sectional enlargement on a free-end side.

5 Claims, 2 Drawing Sheets

(56) References Cited

U.S. PATENT DOCUMENTS 7,086,825 B2 * 8/2006 Wang ..... F04D 29/326
415/173.6

FOREIGN PATENT DOCUMENTS

| | | | |
|---|---|---|---|
| DE | 3137114 | A1 | 4/1982 |
| DE | 102004005028 | A1 | 9/2005 |
| DE | 102004034733 | A1 | 2/2006 |
| DE | 60020866 | T2 | 5/2006 |
| DE | 102005008794 | A1 | 9/2006 |
| DE | 60311768 | T2 | 12/2007 |
| DE | 102007031462 | A1 | 1/2008 |
| DE | 102008046508 | A1 | 3/2010 |
| WO | 9305275 | A1 | 3/1993 |

* cited by examiner

MOTOR-VEHICLE FAN WHEEL WITH REINFORCED SHROUD

CROSS-REFERENCE TO RELATED APPLICATION

This application is a continuation, under 35 U.S.C. §120, of copending international application PCT/EP2012/002519, filed Jun. 15, 2012, which designated the United States; this application also claims the priority, under 35 U.S.C. §119, of German patent application DE 10 2011 105 451.4, filed Jun. 22, 2011; the prior applications are herewith incorporated by reference in their entirety.

BACKGROUND OF THE INVENTION

Field of the Invention

The invention relates to a fan of a motor vehicle, in particular a main fan of an internal combustion engine, having a fan wheel with an outer ring.

Motor vehicles with an internal combustion engine generate a considerable quantity of heat during operation. In order to maintain the operating temperature of the internal combustion engine, generally a coolant is used, said coolant in turn having to be cooled. This takes place by way of cool air which passes over cooling ribs that are in heat exchange relationship with the coolant. As the air flow of driving wind serving as cooling air is normally not sufficient for cooling, in particular at low speeds of the motor vehicle, German published patent application DE 10 2004 034 733 A1 describes, for example, to fasten to the cooler comprising the cooling ribs a fan with a cooler shroud which generates an additional airflow.

Generally, the shroud body has a substantially round recess within which a fan wheel of the fan is located. In this case, the plane in which the fan wheel is located is substantially parallel to the cooler. An electric motor connected to the fan wheel is conventionally fixed by means of screws to a rigid mounting on the front face, wherein the mounting is retained by means of struts which extend, for example, in a radial, tangential or curved manner in the center of the recess. The struts are in turn fixedly connected to the shroud body.

An alternative fastening is described in German published patent application DE 10 2004 005 028 A1. There, the motor is clipped to the mounting on the front face. An electric motor is proposed in German published patent application DE 10 2005 008 794 A1, however, the housing parts thereof being partially formed by the shroud itself.

German published patent application DE 10 2007 031 462 A1 describes a fan wheel, the fan blades thereof being surrounded by an outer ring on the radial outer face, the outer ring in turn extending within a groove of the shroud to exploit the improved airflow. Due to manufacturing tolerances, the spacing between the fan wheel and the shroud has to be selected to be relatively large so that correct operation is ensured. Other designs provide that the air gap between the fan wheel and the shroud body is sealed by means of brush seals which results in a high degree of wear.

SUMMARY OF THE INVENTION

It is accordingly an object of the invention to provide a motor-vehicle fan wheel with reinforced shroud which overcomes the a variety of disadvantages of the prior-known devices and methods of this general type and which provides for a particularly suitable fan and an associated fan wheel.

With the foregoing and other objects in view there is provided, in accordance with the invention, a fan of a motor vehicle, in particular a main fan of an internal combustion engine. The fan comprises:

a fan wheel with an outer ring;

the fan wheel defining a radial direction and an axial direction;

the outer ring having a substantially L-shaped annular cross section, formed by a radial limb with a cross-sectional enlargement at the free end thereof and by an axial limb.

In other words, the fan is configured, in particular, as a main fan of an internal combustion engine comprises a fan wheel which is preferably set in rotational movement by means of a conventional electric motor. Equally, however, it could also be conceivable that the internal combustion engine, which serves to propel the motor vehicle directly or indirectly, drives the fan wheel itself, for example via a belt or a gear mechanism. The fan wheel comprises a number of fan blades, by means of which airflow is generated with a rotational movement of the fan wheel. On the periphery, the fan blades are connected by means of an outer ring, wherein the outer ring has an L-shaped annular cross section.

The annular cross section is substantially formed from a radial limb and an axial limb, to which the fan blades are attached. The axial limb extends, in particular, parallel to the rotational axis of the fan wheel and surrounds the fan blades in a hollow cylindrical manner. The radial limb extends substantially at right angles to the axial limb and, in particular, in a radial direction relative to the rotational axis. Expediently, the radial limb is connected on one side to the axial limb. At the free end, i.e. on the side of the radial limb opposing the axial limb, wherein the free end of the radial limb is preferably located further away from the rotational axis than the end located in the vicinity of the axial limb, the radial limb has a cross-sectional enlargement. The cross-sectional enlargement results in increased stability of the radial limb, so that with a rotational movement of the fan wheel the radial limb has relatively few vibrations. It is recognized that, as a result, disruptive noise and imbalance are avoided. Moreover, the increased stability of the radial limb leads to less deformation thereof in the direction of the rotational axis during the operation of the fan.

Advantageously, the side of the radial limb remote from the axial limb is planar and, as a result, the cross-sectional enlargement, such that the side of the radial limb facing the axial limb at the free end has a bulged portion. For example, the cross-sectional enlargement is bead-shaped, rectangular or triangular. Expediently, the cross-sectional enlargement is integrally formed on the radial limb and, in particular, in one piece therewith. In particular, the fan wheel is produced in one piece from a plastics material. The cross-sectional enlargement thus constitutes a bent-back portion at the free end of the radial limb.

Expediently, the cross-sectional enlargement is substantially peripheral on the peripheral side. In other words, the cross-sectional enlargement of the radial limb is present in any cross section along the rotational axis of the fan wheel through the outer ring. In particular, in this case, the cross-sectional enlargement is uniform. It might also be conceivable; however, that the cross-sectional enlargement is not peripheral but instead configured so as to be interrupted in the manner of teeth or serrations. As a result, the radial limb has the cross-sectional enlargement only in specific cross sections along the rotational axis. In this case, the serrations may be arranged in an irregular manner on the peripheral side along the periphery of the outer ring. The spacing between the serrations thus varies. However, equally a uniform spacing between the serrations is also possible.

In an advantageous embodiment of the invention, the radial limb merges with the axial limb. In the region of the transition, the outer ring comprises a cross-sectional reduction which, for example, has the shape of a bead. In particular, if the outer ring is produced in one piece and in a relatively hot process, for example in an injection-molding method, the outer ring tends to deform upon cooling, which is undesirable and also denoted as distortion. In an outer ring with an L-shaped cross section without a cross-sectional reduction, the two limbs are bent toward one another which lead to an undesirable reduction of the angle between the two limbs. The cross-sectional reduction serves to influence the distortion in a positive manner such that said distortion does not take place or at least to a relatively small extent in the case of largely uniform cooling. Thus, when cooled, the angle between the two limbs and the shape of the outer ring remain substantially constant. The incorporation of the cross-sectional reduction on the outer ring in the region of the transition between the radial limb and the axial limb may also take place independently of the cross-sectional enlargement at the free end of the radial limb and is considered as an independent invention.

In a particularly advantageous embodiment of the invention, the radial limb has the cross-sectional reduction, in particular the side of the radial limb facing the axial limb. The cross-sectional reduction is expediently incorporated in the radial limb on the periphery in the manner of a bead. A region which has a normal cross section is located between the cross-sectional reduction and the cross-sectional enlargement of the radial limb. Thus, the radial limb has at least three regions of different cross sections, wherein the cross sections reduce from the free end thereof toward the region located closest to the axial limb. In this case, in particular, the side of the radial limb remote from the axial limb is planar.

In a preferred embodiment of the invention, the fan has a shroud with a shroud body and a shroud ring. The term "shroud ring" is understood in this case as an indentation within the shroud body, wherein the indentation extends in an annular manner around a recess within the shroud body. The radial limb is incorporated at least partially within the shroud ring and is preferably substantially parallel to the surface of the shroud body around the shroud ring. Along an airflow generated by means of the fan, in this case the radial limb is located substantially upstream of the axial limb. In particular by means of the cross-sectional enlargement of the radial limb, an air gap produced between the shroud and the fan wheel is partially filled. Due to the greater stability of the radial limb and thus reduced deformation during operation of the fan, relatively small spaces between the shroud and the fan wheel may be selected, resulting in a relatively small air gap. In this manner, the airflow is passed through the outer ring and relatively small losses of the airflow in the form of so-called leaking air are produced between the outer ring and the shroud. Thus, a relatively effective airflow is provided by means of the fan.

Other features which are considered as characteristic for the invention are set forth in the appended claims.

Although the invention is illustrated and described herein as embodied in a motor-vehicle fan wheel with reinforced shroud, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DETAILED DESCRIPTION OF THE INVENTION

Figure 1:
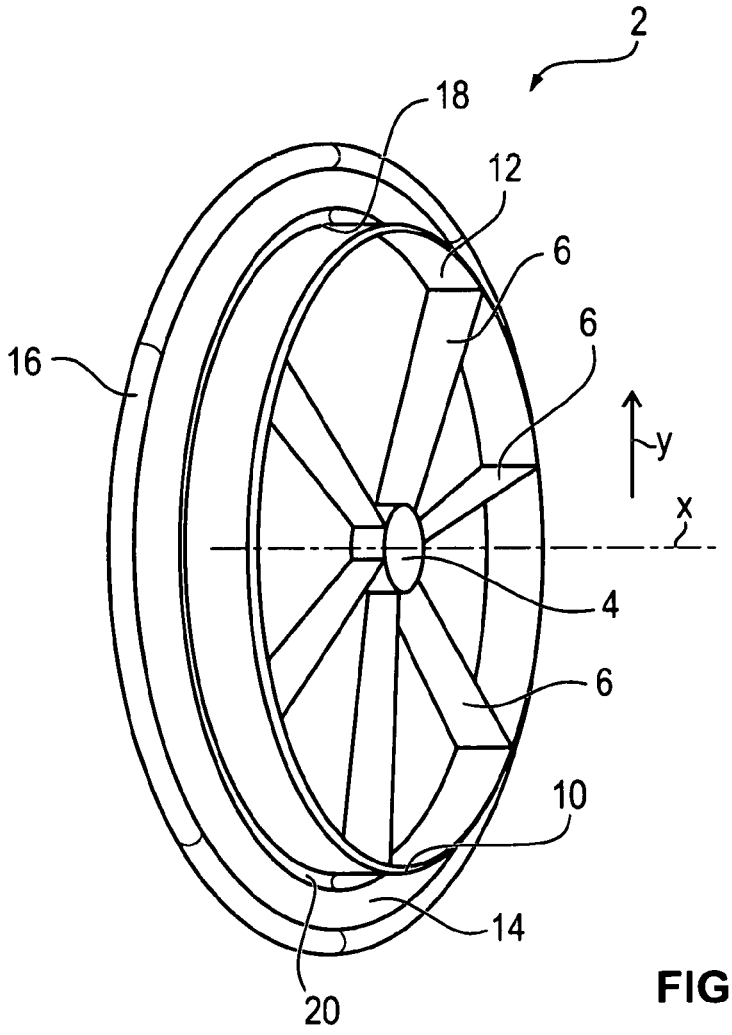
FIG. 1 is a perspective view of a fan wheel with an outer ring.

Referring now to the figures of the drawing in detail and first, particularly, to FIG. 1 thereof, there is shown a fan wheel 2 in a perspective view. The fan wheel is produced integrally in one piece from a plastics material, in particular from polyamide. The fan wheel 2 is heated to a relatively high temperature during the production thereof. For example, the fan wheel 2 is pressed, cast or produced in an injection-molding process. A number of fan blades 6 are arranged around a central hub 4. An electric motor 8 (cf. FIG. 3) may be attached to the hub 4. That is, the electric motor 8 is operatively connected to the fan wheel 2. The fan blades 6 in each case are provided so that with a rotational movement of the fan wheel 2 around the hub 4 along a rotational axis x an airflow is produced by way of the electric motor 8 along the rotational axis x. The fan blades 6 are surrounded by an outer ring 10 which, among other things, serves for stabilizing the fan blades 6 during the rotational movement. By way of the outer ring 10, the airflow is guided and the aerodynamic properties of the fan wheel 2 are improved.

The outer ring 10 has an L-shaped cross section with a radial limb 12 and an axial limb 14. The axial limb 12 is parallel to the rotational axis x and is connected to the fan blades 6. The radial limb 14 is orthogonal (at right angles) to the axial limb 12 and extends from the hub 4 located in the center of the fan wheel 2, outwardly in a radial direction y. In this case, the distance of the radial limb 14 from the hub 4 is substantially greater than that of the axial limb 12. At the free end, the radial limb has a cross-sectional enlargement 16 in the form of a bent-back portion. The cross-sectional enlargement 16 is designed to be entirely peripheral. In other words, the cross-sectional enlargement 16 would produce a closed ring if said ring were to be detached from the radial limb 14. By means of the cross-sectional enlargement 16, the outer edge of the axial limb 12 is stabilized so that with a rotational movement of the fan wheel 2 no vibrations or only relatively weak vibrations of the radial limb 14 are produced. Moreover, during the rotational movement of the fan wheel 2 the radial limb 14 is bent to a relatively small degree in the direction of the rotational axis x. In the region of a transition 18 between the radial limb 14 and the axial limb 12, the outer ring 10 has a cross-sectional reduction 20 in the form of a bead. When cooling the fan wheel 2, said fan wheel tends to deform. By means of the cross-sectional reduction 20, this deformation is counteracted so that the angle between the axial limb 12 and the radial limb 14 during cooling remains constant and thus after cooling corresponds to the angle during the production of the fan wheel 2. A portion of the radial limb 14 which has a normal or standard cross section 22 is located between the cross-sectional reduction 20 and the cross-sectional enlargement 16.

Figure 2:
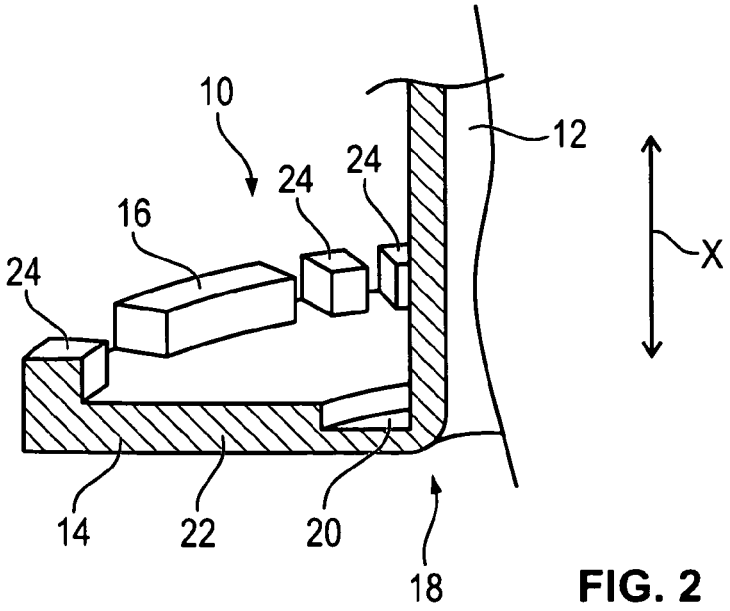
FIG. 2 is a perspective of a detail of an alternative embodiment of the L-shaped outer ring.

FIG. 2 shows in detail a perspective view of an alternative embodiment of the outer ring 10, wherein the outer ring 10 is in section along a plane along the rotational axis x. The cross-sectional reduction 20 in turn has a substantially rectangular cross section and is entirely incorporated in the radial limb 14. Conversely, the cross section of the axial limb 12 is substantially uniform. The outer edge is rounded in the region of the transition 18 between the radial limb 14 and the axial limb 12.

The region of the radial limb 14 which has the normal cross section 22 extends directly adjacent to the cross-sectional reduction 20. Said normal cross section is substantially the same as the cross section of the axial limb 12. In contrast to the cross-sectional enlargement 16 shown in FIG. 1, the cross-sectional enlargement 16 shown in FIG. 2 is not peripheral. The cross-sectional enlargement 16 is instead located at specific regions of the radial limb 14 along the periphery of the outer ring 10. In this manner, the cross-sectional enlargement 16 forms a number of teeth 24, the respective spacing thereof to one another as shown here, being able to vary or also be constant. Similarly, a variation is possible in the length of the teeth 24 along the periphery or in the radial direction. In this manner, for example, imbalance of the fan wheel 2 may be corrected or specifically produced.

Both the cross-sectional reduction 20 and the cross-sectional enlargement 16 are located on the side of the radial limb 14 facing the axial limb 12. In this manner, a planar surface is produced on the side of the radial limb 14 which is remote from the axial limb 12.

Figure 3:
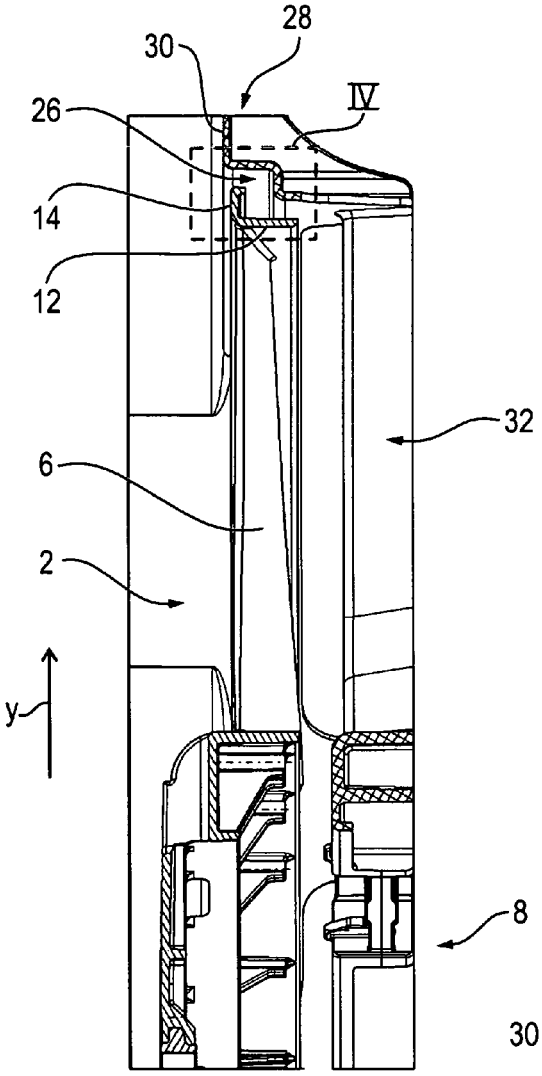
FIG. 3 is a sectional view of the fan wheel within a shroud.
Figure 4:
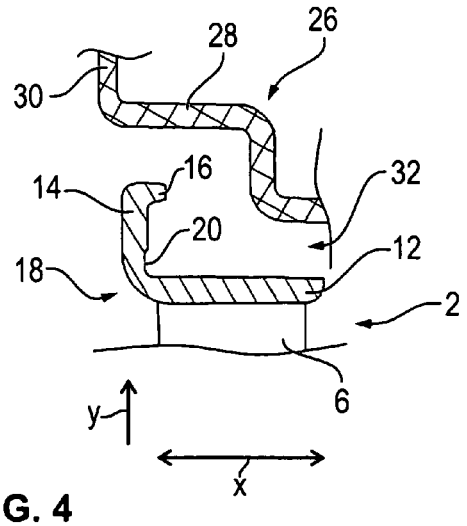
FIG. 4 shows a detail IV of FIG. 3 in a larger scale, with the outer ring partially incorporated in a shroud ring.

FIG. 3 shows in a sectional view in detail the fan wheel 2 along the cutting plane described in FIG. 2. FIG. 4 shows an enlarged detail of FIG. 3. For example, in this case the cross-sectional enlargement 16—comparable with the cross-sectional enlargement 16 shown in FIG. 1—is entirely peripheral. Also shown is a shroud ring 26 of a shroud 28 with a shroud body 30. The shroud ring 26 in this case indicates an indentation within the shroud body 30 which extends in an annular manner around a recess 32 within the shroud body 30, wherein the fan blades 6 are located within the recess 32. The radial limb 14 is incorporated partially within the shroud ring 26, wherein the planar side of the radial limb 14 is substantially parallel to the surface of the shroud body 30 and is located in a plane which extends in the radial direction y, wherein the rotational axis x is located perpendicular to said plane. The airflow produced by means of the fan wheel 2 is deflected by means of the shroud 28 through the recess 32, wherein the radial limb 14 is located along the airflow upstream of the axial limb 12. Due to the relatively high degree of stability of the radial limb 14, as a result of the cross-sectional enlargement 16, a relatively small spacing may be selected between the shroud 28 and the fan wheel 2, without the fan wheel coming into contact with the shroud 28, with a rotational movement of said fan wheel 2. In this manner, the airflow is deflected relatively effectively through the shroud 28 and relatively low losses in the form of so-called leaking air are produced in the edge region of the fan wheel 2.

In a manner not shown in more detail, both the shroud 28 and the electric motor 8 and the fan wheel 2 are a component of a fan 34 of a motor vehicle with an internal combustion engine, which drives the motor vehicle directly, for example via a gear mechanism, or indirectly in the manner of a so-called hybrid drive. By way of the fan 34, the internal combustion engine is cooled directly or indirectly. The indirect cooling takes place by the internal combustion engine being cooled by means of a coolant which in turn is in heat exchange with a conventional cooler for cooling purposes. The fan 34 and specifically the shroud 28 is attached to the cooler. The airflow generated by means of the fan 34 flows through the cooler and thus cools said cooler.

The invention is not limited to the exemplary embodiments described above. On the contrary, other variants of the invention may be derived therefrom by the person skilled in the art without departing from the subject-matter of the invention. In particular, all of the individual features described in connection with the exemplary embodiments are also able to be combined with one another in different ways without departing from the subject-matter of the invention.

The invention claimed is:

1. A fan of a motor vehicle, comprising:

a fan wheel with an outer ring and a hub defining a rotational axis;

said fan wheel defining a radial direction and an axial direction;

said outer ring having a substantially L-shaped annular cross section, formed by a radial limb with a standard cross section and a cross-sectional enlargement at a free end thereof and by an axial limb, said outer ring, in a transitional region between said radial limb and said axial limb, being formed with an annular cross-sectional reduction of said radial limb being annular about said hub and said rotational axis, said cross-sectional reduction being radially inward of said standard cross section and said standard cross section being greater than said cross-sectional reduction.

2. The fan according to claim 1, configured as a main fan of an internal combustion engine.

3. The fan according to claim 1, wherein said cross-sectional enlargement is formed substantially circumferentially along a periphery of said radial limb.

4. The fan according to claim 1, wherein the limb portion with the standard cross section extends between said cross-sectional reduction and said cross-sectional enlargement.

5. The fan according to claim 1, which comprises a shroud with a shroud ring having said radial limb at least partially incorporated therein, and wherein said radial limb is disposed along an airflow produced by the fan and substantially upstream of said axial limb.

* * * * *